United States Patent [19]

Nakai et al.

[11] 4,131,824

[45] Dec. 26, 1978

[54] FILTER DEVICE FOR HIGH FREQUENCY GENERATING DEVICE

[75] Inventors: Kaichiro Nakai; Hisao Saito, both of Yokohama, Japan

[73] Assignee: Tokyo Shibaura Electric Co., Ltd., Kawasaki, Japan

[21] Appl. No.: 778,745

[22] Filed: Mar. 17, 1977

[30] Foreign Application Priority Data

Sep. 20, 1976 [JP] Japan ..... 51-111809

[51] Int. Cl.[2] ..... H01J 25/50

[52] U.S. Cl. ..... 315/39.51; 315/39.53; 333/79; 315/85

[58] Field of Search ..... 315/39.51, 39.53, 85; 333/79, 97

[56] References Cited

U.S. PATENT DOCUMENTS

| | | | |
|---|---|---|---|
| 3,732,459 | 5/1973 | Oguro et al. | 315/39.53 |
| 3,846,667 | 11/1974 | Hisada et al. | 315/39.53 |
| 3,859,558 | 1/1975 | Harada et al. | 315/39.53 |
| 3,922,612 | 11/1975 | Tashiro | 315/39.51 |
| 3,980,975 | 9/1976 | Maxon, Jr. et al. | 333/97 |

*Primary Examiner*—Saxfield Chatmon, Jr.
*Attorney, Agent, or Firm*—Cushman, Darby & Cushman

[57] ABSTRACT

A magnetron includes a high frequency generating source having an anode and a cathode, two power supply conductors for supplying electric power to the cathode of the high frequency generating source, filter circuits inserted in the power supply conductors for damping and suppressing the high frequency components leaking through the power supply conductors and a shield box covering the two power supply conductors and two filter circuits. Each of the filter circuits includes a capacitor and a choke which is comprised of an coreless type inductor made of coreless coil and a core type inductor made of ferrite-cored coil. The coreless type inductors of two filter circuits connected to the respective different power supply conductors are different each other in inductance.

12 Claims, 14 Drawing Figures

FILTER DEVICE FOR HIGH FREQUENCY GENERATING DEVICE

BACKGROUND OF THE INVENTION

The present invention relates to a high frequency generating device and, more particularly, to a filter devices for a high frequency generating device.

High frequency generating devices such as, for example, magnetron, klystron, traveling-wave tube and semiconductor device, have found their various uses. The high frequency generating device is frequently provided with a filter device for restricting undesirable leaks of high frequency energy. The leaks of high frequencies become the cause of noise in radio and TV receivers or other electronic apparatuses. For this, the filter device for restricting such high frequency leaks is very important in the high frequency generating devices. The filter device generally comprises inductance elements such as choke elements, capacitors and a shield box and is generally connected to the power supply conductors. The improvement of the filter circuit is disclosed in U.S. Patent No. 3,922,612 issued on Nov. 25, 1975 and assigned to the assignee of the present application. For the choke element of the filter circuit, a core type inductor is usually used, which is small in size and high in performance. As described in the above-mentioned patent, the core type inductor is a choke element of a combination of a coil and a member having a large high frequency loss and high magnetic permeability such as ferrite. Since ferrite or material including mainly ferrite has high magnetic permeability and good high frequency absorptive characteristic, the core type inductor serves as an inductance element to the high frequency components within a frequency range and exhibits its good high frequency absorptive nature for other high frequency components to damp them. However, the core type inductor is frequently heated to an extremely high temperature, thereby resulting possibly in burning of the core, i.e. the ferrite. This arises from the fact that, when the high frequency energy through the power supply conductors is extremely high, the core absorbes most of the high frequency energy, and that the core is disposed at the high electromagnetic field of the standing wave developed in the power supply conductors.

SUMMARY OF THE INVENTION

Accordingly, an object of the present invention is to provide a high frequency generating device with a filter device preventing leaks of high frequency components.

Another object of the present invention is to provide a high frequency generating device with a filter device having a construction whose core is prevented from burning.

According to the present invention, there is provided a high frequency generating device comprising a high frequency generating source, a shield box mounted to the high frequency generating source in which undesirable high frequency leaks from the high frequency generating source is confined, power supply conductors connected electrically to the high frequency generating device and extending to exterior through the inside of the shield box, and choke elements including core type inductors with high frequency absorptive member as its core which are inserted to the power supply conductors within the shield box for damping noise and the high frequency leaks genated in the high frequency generating source for restriction them, and coreless type inductors with no core of high frequency absorptive member, both the cores being connected in series.

DESCRIPTION OF THE PREFERRED EMBODIMENTS

Figure 1:
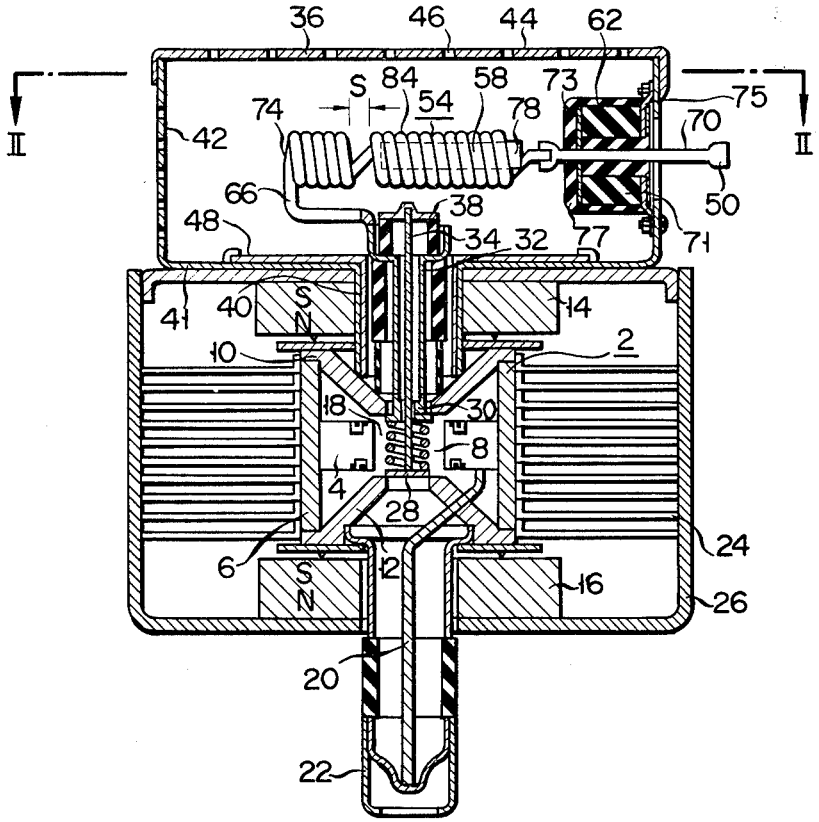
FIG. 1 is a longitudinal sectional view of an embodiment of a magnetron according to the present invention.
Figure 2:
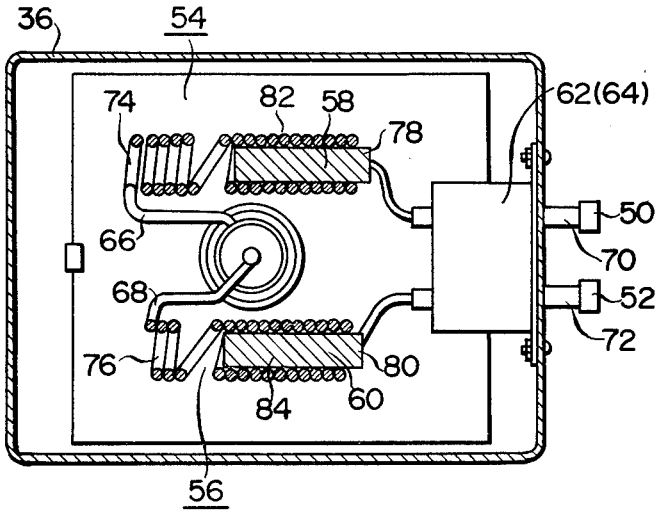
FIG. 2 is a cross sectional view taken along sectional line II—II of FIG. 1.

Embodiments of a magnetron as shown in FIGS. 1 and 2 according to the present invention will now be described by way of example and with reference to the accompanying drawings. It will be understood, however, that the present invention concerning a filter device is applicable for other high frequency device such as, for example, klystron.

Before describing the filter device of a high frequency generator which is a subject matter of the present invention, the construction of a magnetron as an example of the high frequency generators will be given with reference to FIGS. 1 and 2. In the specification, some words indicating direction, relative position, and the like are used only in connection with the view of the drawings, for the sake of clearness and brevity.

As shown, a high frequency generating source 2 is comprised of a cylindrical anode 6 including a plurality of vanes 4 which are radially and inwardly projected therefrom to define resonance cavities, and a coiled cathode 8 disposed at the center of the cylindrical anode 6. A pair of pole pieces 10 and 12 are oppositely disposed at the upper and lower ends of the cylindrical anode 6, respectively. Those pole pieces 10 and 12 are extended at the center in the space defined by the cylindrical anode 6. The pole pieces 10 and 12 are magnetically coupled with circular magnets 14 and 16 disposed outside the anode 6, respectively, to form a magnetic field parallel with the anode axis in an electron interation space 18 between the anode vanes 4 and the cathode 8. One of the anode vanes 4 is connected with an output conductor 20 which further is connected with an output antenna terminal. The output conductor 20 and the terminal 22 constitute an output antenna radiating a high frequency energy generated in the resonant cavities. A radiator 24 is fixedly disposed around the cylindrical anode 6. The permanent magnets 14 and 16 are magnetically coupled to each other through a magnetic yoke 26 to form a magnetic circuit.

Both ends of the coiled cathode 8 is mechanically and electrically coupled with end hats 28 and 30. The upper end hat 30 is fixed to one end of a cathode supporting sleeve 32 for power supply, while the lower hat 28 is fixed to one end of an electrode supporting bar 34 for power supply elongating in the sleeve 32. The electrode supporting bar 34 and the cathode supporting sleeve 32 pass through the annular permanent magnet 14 to extend at the other end in a shield box 36. The electrode supporting bar 34 is supported by a stem 38 closing an upper opening of the sleeve 32. The shield box 36 includes a tubular portion 40 which is outwardly projected from the bottom wall 41 of the shield box 36. The bottom wall 41 is electrically coupled with the pole piece 10, so that the shield box 36 is short-circuited to the cylindrical anode 6, thereby being kept at the ground potential. The shield box 36 is comprised of the bottom wall 41, a side wall 42 and a cover 44, the side wall 42 and the cover 44 having air perforations 46 for heat dissipation. Each perforation is sized to an extent that a high frequency energy is not leaked. To secure a sure insulation between the shield box 36 and the cathode supporting sleeve 32, an insulator 48 such as silicon rubber is laid over the bottom wall 41 of the shield box 36 and the inner surface of tubular portion 40.

The shield box 36 is provided at the outside with two cathode terminals 50 and 52 for power supply. A filter circuit 54 is provided between the cathode terminal 50 and the cathode supporting sleeve 32, and another filter circuit 56 between the cathode terminal 52 and the cathode supporting bar 34. Those filters are used to damp a high frequency energy, signals of UHF and VHF and the like leaking from the high frequency generating source 2 through the electrode supporting sleeve 32 and the cathode terminal 52, those possibly causing noise in radio and television receivers or the like. The filter 54 includes a choke element 58, a capacitance element 62 and a power supply conductor 66. The filter 56 includes a choke element 60, a capacitance element 64 and a conductor 68. In this example, the capacitance elements 62 and 64 are of the feed-through type. The feed-through type capacitors 62 and 64 includes conductors 70 and 72 extending through the centers of the capacitors 62, 64, and a circular ferroelectric member 71 of which one end is coupled with the conductors 70 and 72 through a electrode plate 73 and other end is coupled with the shield box 36 through a grounded plate 75, and a mold resin member 77. The ends of the conductors 70 and 72 constitute cathode terminals 50 and 52 of the magnetron. The choke element 58 includes a coreless type inductor 74 formed by coiling the part of the insulated conductor wire 66, and a core type inductor 82 formed by coiling the part of insulated conductor 66 around a high frequency absorptive member 78 such as ferrite which is disposed substantially coaxial with the coreless inductor 74. The choke element 60 similarly includes a coreless type inductor 76 of a coiled part of the insulated conductor 68, a core type inductor 84 coiled around a high frequency energy absorptive member 80 such as ferrite, which is disposed substantially coaxial with the coreless inductor 76. The inductors 74 and 76 are spaced from the inductors 82 and 84, respectively, by a space (S) of one pitch of the coil or more, thereby reducing magnetic coupling therebetween.

Figure 3:
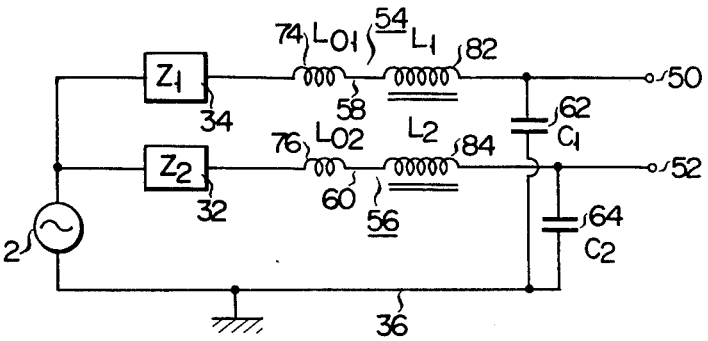
FIG. 3 is an equivalent circuit of a cathode circuit of the magnetron of FIG. 1.

Referring now to FIG. 3, there is shown an equivalent circuit of the cathode circuit including the filter circuits 54 and 56, a high frequency generating source 2 considered as a high frequency wave leakage source against the filter circuit, circuit constants $Z_1$ and $Z_2$ existing in the lines from the high frequency generating source 2 to the cathode terminals 50 and 52 and a grounded line comprising the shield box 36 and the cylindrical anode 6. The circuit constant $Z_1$ of the line including the negative supporting bar 34 and the conductor 66 and the constant $Z_2$ of the line including the cathode supporting sleeve 32 and the conductor 68 are normally different and imbalanced to each other. The reactances of the filter circuit are empirically determined so as not to prevent leaks of microwaves, UHF and VHF through the filter circuits 54 and 56, by taking account of the circuit constants, i.e. the impedances $Z_1$ and $Z_2$. The reactances of the filter circuit includes the capacitances $C_1$ and $C_2$ of the feed-through type capacitors 62 and 64, the inductances $L_{01}$ and $L_{02}$ of the coreless type inductors 74 and 76, the inductances $L_1$ and $L_2$ of the core type inductors 82 and 84. Apparantly, those reactances are not the same for every high frequency generating devices, but different in every devices. As mentioned above, the filter circuit of the high frequency generating device of the present invention includes not only core type inductors 82 and 84 and the feed-through type capacitors 62 and 64, but also the coreless type inductors 74 and 76. The coreless type inductors 74 and 76 are provided in the filter circuits 54 and 56 in order that the core type inductors 82 and 84 are not positioned in the maximum electric field regions of standing waves developed on the lines including the filter circuits 54 and 56. The core type inductors 82 and 84 use the material having an extremely high absorption for high frequency such as ferrite. For this, if the standing waves occur and these components are positioned at the maximum electric field regions, those components are heated to an extremely high temperature, resulting possibly in buring of the insulated conductors. On the other hand, the coreless inductors 74 and 76 are not heated even if they are positioned at the maximum electric field region. It is for this reason that the coreless type inductors 74 and 76 are used in the filter circuits 54 and 56. The respective inductances of the coreless type inductors 74 and 76 are different since the respective circuit constants $Z_1$ and $Z_2$ are different so that the reactance values are determined on the basis of the measuring values. As seen from FIGS. 1 and 2, the number of turns of the inductor coils 74 and 76 are different. In this example of the high frequency generating device, i.e. the magnetron, the impedance $Z_1$ of the line including the cathode supporting bar 34 and the conductor 68 is larger than the impedance $Z_2$ of the line including the cathode supporting sleeve 32 and the conductor 66. Accordingly, the inductance $L_{01}$ of the coreless inductance 76 is small as compared with the inductance $L_{02}$ of the coreless type inductor 74. That is, the number of turns of the inductor 76 is lower than that of the inductor 74.

As described above, the filter circuits 54 and 56 are each comprised of a combination of an coreless inductor and a core inductor having the core of the high frequency absorptive material both being connected in series to the power supply line. This permits an arrangement that the high frequency absorptive members 78 and 80 are disposed avoiding extremely high electric field regions. Therefore, the filter circuit of the present invention eliminates burning of the high frequency absorptive member and the insulating layer of the insulated conductor forming the coil. The coreless type inductor 74 and the core type conductor 82 are formed by coiling a single insulated conductor with a gap therebetween. For this, the magnetic coupling between the cordless type inductors 74 and the core type conductor 82 is weak so that the coreless type inductors 74 and 76 are effectively operable without any deterioration of the functions thereof.

FIG. 4 to 13 will be referred to for explaining other embodiments of the filter circuit for a high frequency generating device according to the present invention.

Figure 4:
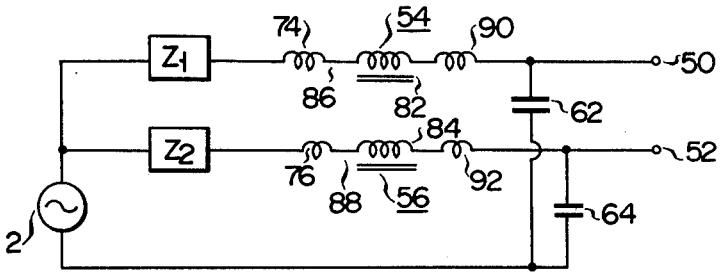
FIGS. 4 and 5 are equivalent circuits of the cathode circuits which are modifications of FIG. 1.

Reference will now be made to FIG. 4 illustrating an equivalent circuit of a cathode circuit of a high frequency generating device. In the figure, a choke element 86 of the filter circuit 54 includes a core type inductor 82 disposed in series between two coreless inductors 74 and 90, and a choke element 88 of the filter circuit 56 similarly includes a core type inductor 82 in series connected between two coreless inductors 76 and 92. The choke element 86 is disposed between the feed-through type capacitor 62 and the cathode supporting sleeve 32, and the choke element 88 similarly is disposed between the feed-through type capacitor 64 and the cathode supporting bar 34. With such a circuit construction, it is easy not to dispose the core type inductor 82 at a high electric field of the standing wave formed by suitably selecting the inductances of the coreless type inductors 74 and 90 respectively. Accordingly, the core, that is, the high frequency absorptive member is surely prevented from being heated excessively.

Figure 5:
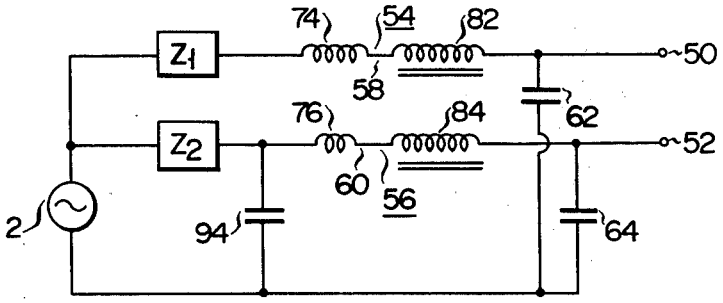

FIG. 5 shows another equivalent circuit of the cathode circuit of a high frequency generating device. In the circuit, a capacitor 94 is connected in parallel with a series circuit comprising the coreless inductor 76 and the feed-through type capacitor 64 of the choke element 60 of the filter circuit 56. In other words, the capacitor 94 is connected between the cathode supporting bar 34 and the shield box 36. The choke element 60 connected in parallel with the capacitor 94 includes the coreless inductor 76 whose inductance is smaller than that of the coreless inductor 74 of the other choke element 58. As just mentioned, according to this example, a reactance element such as a capacitance 94 is additionally connected to the filter circuits 54 or 56 so that the reactance of the filter circuit 54 or 56 is changeable, thus permitting the high frequencies to be greatly damped.

Figure 6:
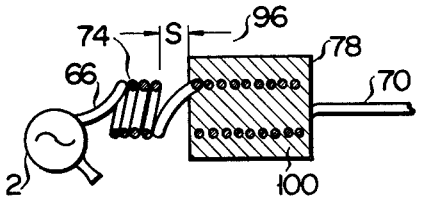
FIG. 6 schematically shows a cross sectional view of a choke element which is a modification of the FIG. 1 choke.

FIG. 6 shows a modification of the choke coil 58 or 60 shown in FIG. 2. A core type inductor 100 of the choke element 96 is formed by the power supply conductor 66 and molding with the high frequency absorptive material 78 of ferrite material or material including ferrite with the resultant coil incorporated therein. The choke element 96 thus formed is comprised of the core type inductor 100 entirely covered with high frequency absorptive material so that it is excellent in high frequency absorption. Further, the coreless inductor 74 is disposed apart from the core type inductor 100. This prevents the core type inductor 100 from excessively absorbing high frequency energy.

Figure 7:
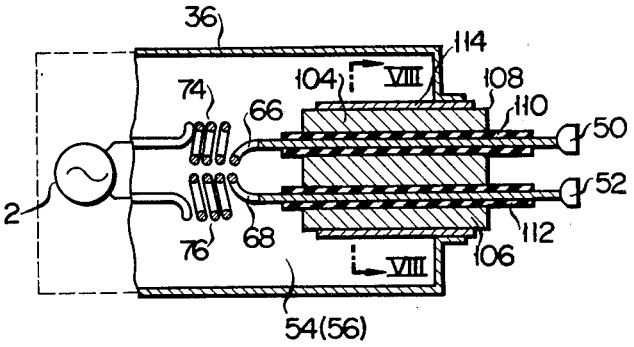
FIGS. 7 and 8 schematically show a longitudinal sectional view of filter circuit which are a modification of the filter circuit shown in FIG. 1 and a cross section taken along sectional line VIII—VIII of FIG. 7.
Figure 8:
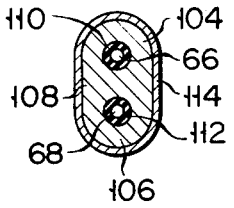

Turning now to FIGS. 7 and 8, there is shown a modification of the filter circuits 54 and 56 shown in FIG. 2. In this example, the core type inductors 104 and 106 for the respective filter circuits are formed in such a manner that the power supply conductors 66 and 68 covered with insulation layer 110 and 112 are inserted through holes of a ferrite bead 108. The ferrite bead 108 is covered with the conductive cover 114 connecting with the shield box 36. The capacitance formed between the conductors 66 and 68 and the cover 114 functions as a capacitor. Therefore, unlike the embodiments of FIG. 1 and 2, this example does not need additional feed-through type capacitors 62 and 64.

Figure 9:
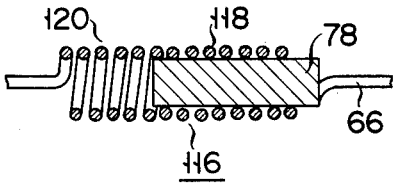
FIGS. 9 through 13 schematically show cross sectional and side views of modifications of the choke elements of the high frequency generating device according to the present invention.

Turning to FIGS. 9 to 13, there are shown some other embodiments of the choke elements 58 or 60 of the filter circuits 54 or 56. The choke element 116 in FIG. 9 is formed by coiling a power supply conductor 66 at an equal pitch into a straight coil with a bar-like ferrite core 78 inserted partly into the coil. The ferrite inserted portion of the coil functions as the core type inductor 118 and the other portion of the core as the coreless inductor 120.

Figure 10:
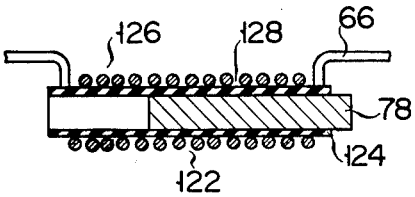

Another choke is shown in FIG. 10, in which a tube 124 having the magnetic permeability substantially equal to air and high frequency absorptive characteristic, is inserted into a continuous coil as shown in FIG. 9, and a ferrite core 78 is partly inserted into the tube 124. The choke element 122 is comprised of the coreless type inductor 126 having no ferrite core 78 and the core type inductor 128 having the ferrite core 78 inserted thereinto. The choke element 122 of this example has a construction that the inserted length of the ferrite core 78 is easily adjustable. Accordingly, the inductance ratio of the coreless type inductor to the core type inductor is also easily adjustable. For this, the positioning of the core type inductor 128 so as not to be placed at the high electric field of standing wave is easy. Incidentally, the tube 124 fitted in the coreless inductor 126 has the magnetic permeability substantially equal to that of air and it does not absorb high frequency components. Accordingly, the coil with such a tube may be considered as a coreless type inductor.

Figure 11:
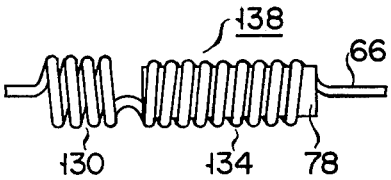
Figure 12:
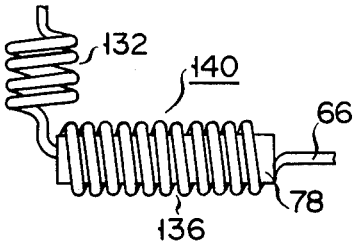

Referring now to FIGS. 11 and 12. there are shown two choke elements 138 and 140 of the type in which the coreless type and the core type inductors are coupled with a weak mutual inductance. The choke element 138 in FIG. 11 includes the coreless inductor 130 and the core inductor 134. Likewise, the choke element 140 in FIG. 12 comprises the coreless inductor 132 and the core type inductor 136. The turning direction of the coil of the coreless type inductor 130 in FIG. 11 is opposite to that of the core type inductor 134. The axis of the coreless type inductor 132 is intersected with that of the core type inductor 136 in FIG. 12.

Figure 13:
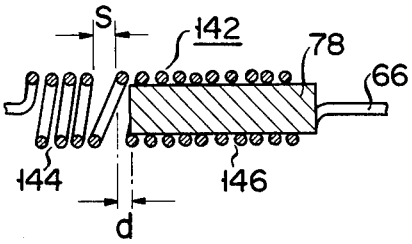

A choke element 142 shown in FIG. 13 has a relatively wider gap (S) and a narrower gap (d) adjacent each other between the coreless inductor 144 and the core type inductor 146. The gap (S) is formed by widening the pitch of the coil constituting the inductors 144 and 146, and the gap (d) is formed by slightly shifting the ferrite core 78 toward the inside of the coil of the core type inductor 146. The provision of the narrower gap (d) enables the coreless type inductor 144 to be operable satisfactorily even if the gap (S) is made small, and it enables the entire length of the choke element 142 to be short.

Figure 14:
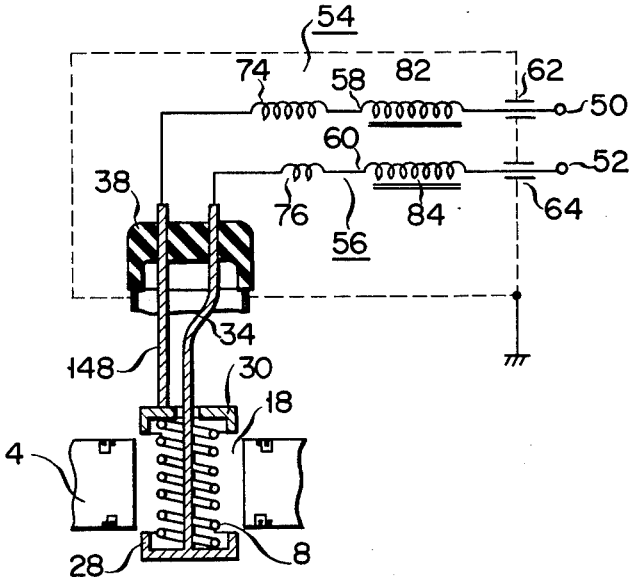
FIG. 14 schematically shows another embodiment of the high frequency generating device of the present invention in which an equivalent circuit of the cathode circuit and a part of the high frequency generating source are depicted.

FIG. 14 shows an embodiment of the present invention in case where the structure of the current supply means to the cathode of a high frequency generating device is different from the FIG. 1 device. In the FIG. 14 embodiment, the cathode supporting bar 34 and a cathode supporting bar 148 which is used in place of the cathode supporting sleeve 32 in FIG. 1 are connected to end hats 28 and 30 respectively, the pair of end hats 28 and 30 supporting the cathode 8. In this way, if the current supplying means are the current supply cathode supporting bars 34 and 148, the use of the filter device for high frequency generating device of this invention is effective, if the circuit constants are different, corresponding to these circuit constants.

As described above, the present invention provides a filter device for a high frequency generating device which prevents leak of high frequency energy surely and safely.

What we claim is:

1. A high frequency generating device comprising:

a high frequency generating source;

a shield box mounted to said high frequency generating source in which undesirable high frequency energy generated from said high frequency generating source is confined;

power supply conductors connected electrically to said high frequency generating device and extending to the exterior through the inside of said shield box; and a choke element which is connected to said power supply conductor with in said shield box for damping said undesirable high frequency energy generated in said high frequency generating source, including a core type inductor with a high frequency absorptive member as its core and a coreless type inductor with no core of high frequency absorptive member, said inductors being connected in series.

2. A high frequency generating device according to claim 1, in which said choke element comprises a series circuit including said coreless type inductor and said core type inductor said coreless type inductor being connected to said high frequency generating source.

3. A high frequency generating device according to claim 1, in which said high frequency absorptive member is made of at least one material selected from the group consisting of ferrite and material including ferrite.

4. A high frequency generating device according to claim 1, in which said choke element is formed by coiling the power supply conductor.

5. A high frequency generating device according to claim 1, in which said core type and coreless type inductors of said choke element are formed by coiling the power supply conductor.

6. A high frequency generating device according to claim 5, in which said core type inductor of said choke element comprises a coil formed by coiling the power supply conductor and the high frequency absorptive member.

7. A high frequency generating device according to claim 1, in which said both inductors are coils formed by coiling conductors, said core type inductor includes a high frequency absorptive member as its core partly inserted therein, and said coreless type inductor is the remaining portion of said coil where no core is inserted.

8. A high frequency generating device according to claim 1, in which said both inductors are coils formed by coiling conductors, and the turning directions of said core type and coreless type inductors are opposite to each other.

9. A high frequency generating device according to claim 1, in which said both inductors of said choke elements are coils formed by coiling conductors with equal pitches, respectively, and said both inductors are electrically connected spaced to each other by the space of one pitch or more.

10. A high frequency generating device according to claim 1, in which said both inductors are coils formed by coiling conductors, said both coils which are connected each other in series are disposed with their axis not substantially alignment with each other.

11. A high frequency generating device according to claim 1, in which said both inductors are coils formed by coiling conductors, both the coils being electrically connected to each other with a slight gap therebetween, and a minute coreless portion is provided at the end of said core type inductor confronting said coreless type inductor, said minute coreless portion having no high frequency absorptive core disposed thereat.

12. A high frequency generating device according to claim 1, in which said power supply conductors and choke elements electrically connected with said high frequency generating source are plural and said chokes are inserted to said power supply conductors, respectively, and said coreless type inductors of said choke elements connected with said power supply conductors, respectively, at least one of which have a different inductance from that of the other coreless type inductors.

* * * * *